US007234371B1

(12) United States Patent
Ritz

(10) Patent No.: US 7,234,371 B1
(45) Date of Patent: Jun. 26, 2007

(54) REMOVABLE VISE HANDLE

(76) Inventor: Eugene A. Ritz, 224 Kilgallen Rd., Butler, PA (US) 16002

( * ) Notice: Subject to any disclaimer, the term of this patent is extended or adjusted under 35 U.S.C. 154(b) by 171 days.

(21) Appl. No.: 11/001,480

(22) Filed: Dec. 1, 2004

(51) Int. Cl.
*G05G 1/10* (2006.01)

(52) U.S. Cl. ..... 74/543; 70/19; 70/224

(58) Field of Classification Search ..... 74/543, 74/544–545, 548, 558.5, 5; 70/19, 229, 224
See application file for complete search history.

(56) References Cited

U.S. PATENT DOCUMENTS

| | | | | |
|---|---|---|---|---|
| 1,072,559 | A * | 9/1913 | Bacon | 70/19 |
| 1,350,773 | A | 8/1920 | Bentley | |
| 2,144,837 | A * | 1/1939 | Douglas | 70/19 |
| 2,605,630 | A * | 8/1952 | Keeler | 70/181 |
| 3,600,912 | A * | 8/1971 | Foreman | 70/77 |
| 3,806,107 | A | 4/1974 | Pitzer | |
| 4,139,188 | A | 2/1979 | Avedian | |
| 4,912,949 | A * | 4/1990 | Bowers | 70/19 |
| 5,347,835 | A * | 9/1994 | Dewey | 70/202 |
| 5,857,477 | A * | 1/1999 | James | 135/88.06 |
| 6,305,107 | B1 * | 10/2001 | Parenti | 40/201 |
| 6,354,119 | B1 * | 3/2002 | Molzer | 70/210 |
| 6,595,508 | B2 * | 7/2003 | Duncan | 269/242 |
| 6,834,896 | B2 * | 12/2004 | Smith | 292/259 R |
| 2003/0214089 | A1 | 11/2003 | Duncan | |

* cited by examiner

*Primary Examiner*—Richard Ridley
*Assistant Examiner*—Matthew A Johnson
(74) *Attorney, Agent, or Firm*—David C. Jenkins; Eckert Seamans Cherin & Mellott, LLC

(57) ABSTRACT

A locking, removable handle assembly for a vise is provided. The vise has a threaded rod, a fixed jaw, and a movable jaw as is known in the art. The handle assembly includes a base assembly, an elongated handle member, and a lock assembly. The base assembly is structured to be fixed to the threaded rod. The elongated handle member is structured to be coupled to the base assembly. The lock assembly is structured to selectively couple the handle member to the base assembly.

4 Claims, 3 Drawing Sheets

REMOVABLE VISE HANDLE

BACKGROUND OF THE INVENTION

1. Field of the Invention

This invention relates to a vise handle and, more specifically, to a removable and lockable vise handle.

2. Background Information

A bench vise is a common work shop tool used to secure a workpiece. The vise typically has a fixed jaw and a movable jaw which are coupled together by a threaded rod. The movable jaw is structured to move toward or away from the fixed jaw when the threaded rod is rotated. The threaded rod is typically rotated manually by a handle. The handle typically extends generally perpendicular to the threaded rod. To improve leverage and to make rotating the threaded rod easier, the handle is typically structured to slide relative to the threaded rod. That is, the threaded rod, or an attachment device fixed thereto, includes an opening that extends across the diameter of the rod and the handle, which is an elongated rod having a cross-sectional area that is smaller than the cross-sectional area of the opening, and is disposed in the opening. Each end of the handle includes a wide portion, that is, a portion having a cross-sectional area greater than the cross-sectional area of the opening. Thus, the handle can move from a first position wherein one end is adjacent to the threaded rod, to a second position, wherein the other end is adjacent to the threaded rod. A worker used one hand to hold a workpiece between the vise jaws while the other hand used the handle to close the jaws. The sliding handle allowed the user to place the handle in a position for a comfortable grip and natural motion. That is, a fixed handle for example, would typically require the user's handle hand to move into an uncomfortable orientation at some point as the handle rotated through 360 degrees.

The disadvantage to the traditional handle is that it cannot be removed. As such, the handle generally extends from the edge of a work bench into an area where people typically walk or move around the work bench. A handle extending into the walkway was likely to cause injury. A non-removable handle may also make the vise an attractive nuisance to those unaccustomed to working with vises. For example, children may use the vise in an unsafe manner. Further, in a school shop or technology laboratory setting, the rattling of vise handles is a source of annoyance for teachers during lecture or demonstrations.

One known solution to certain of these disadvantages was to provide a removable handle. These handles, such as the handle shown in U.S. Pat. No. 1,350,773, also have disadvantages. Such handles are rigid and do not incorporate the sliding action of fixed handles. Accordingly, to place the handle in the proper orientation for comfortable use, the user must remove the handle, adjust the orientation and reattach the handle. Additionally, because such handles are not lockable, the handles may be removed, and even stolen, by unauthorized users.

There is, therefore, a need for a removable and lockable vise handle.

There is a further need for a removable and lockable vise handle that slides in relation to the vise threaded rod.

SUMMARY OF THE INVENTION

These needs and others are met by the present invention which provides a vise handle which is both lockable and removable. The removable handle includes a base member, which is fixed to the vise threaded rod, a handle member and a locking assembly. Preferably, the base member is a tubular member with a lateral coupling device. The coupling device is structured to attach the base member to the threaded rod. The tubular member has an inner cross-sectional area and a longitudinal axis. The longitudinal axis extends generally perpendicular to the vise threaded rod. The handle member is an elongated rod having a first end portion, a second end portion and a medial portion. The medial portion has a cross-sectional area that is smaller than the cross-sectional area of the tubular member inner cross-sectional area. In one embodiment, the first and second end portions of the rod have a cross-sectional area that is larger that the cross-sectional area of the tubular member. Hereinafter, where the first and second end portions have a greater cross-sectional area than the tubular member inner diameter, the first and second end portions will be referred to as "wide end portions." The locking assembly couples the handle member to the base member as described below.

In one embodiment, the second wide end portion is fixed to the medial portion and the first wide end portion is coupled to the medial portion by the locking assembly. The locking assembly includes a key, a housing and a bolt. Preferably, the housing corresponds to the wide area first end. That is, the locking assembly is, essentially, a cap that may be locked to one end of the rod. The key is structured to move the bolt between a first, retracted position, and a second, extended position. When the bolt is in the first retracted position, the bolt does not engage the rod. In the second, extended position, the bolt engages the rod. Thus, when the bolt is in the first, retracted position, the housing, and thus the first wide-end portion, can be removed from the rod. When the housing is removed from the rod, the rod may be withdrawn from the tubular member. When the locking assembly is coupled to the rod and the bolt is in the second, extended position, the rod may not be removed from the tubular member.

In another embodiment, the locking assembly is disposed on the base member. In this embodiment, the base assembly is still a tubular member with a lateral coupling device. The handle member is still a rod, however, the rod does not have wide end portions, and instead includes a centered channel. A "centered channel" is a channel that extends longitudinally along the rod, but does not extend to the ends of the rod. The locking assembly is disposed on the tubular member and includes a bolt that moves between a first, retracted position and a second, extended position wherein the bolt extends into the channel. Thus, due to the closed ends of the channel, when the bolt is extended into the channel, the rod may slide through the tubular member until the bolt contacts the end of the channel. When the bolt is moved into the first, retracted position, the rod may be removed from the tubular member.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
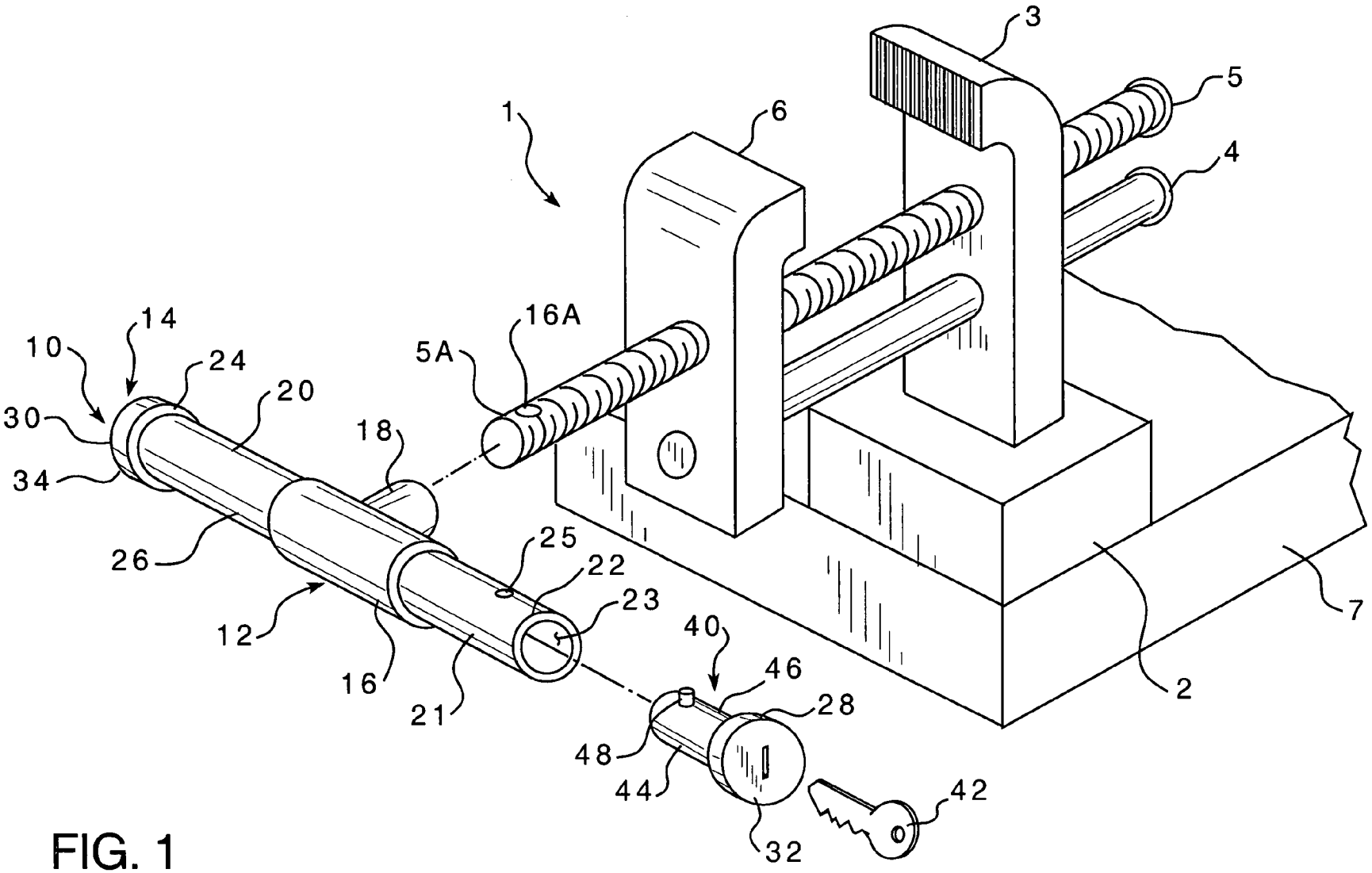
FIG. 1 is an isometric view of the locking, removable handle assembly for a vise.

As shown in FIG. 1, a vise 1 includes a base 2, a fixed jaw 3, a guide rod 4, a threaded rod 5, and a movable jaw 6. The base 2 is typically coupled to the top of, or underneath, a corner of a workbench 7. The fixed jaw 3 is fixed to the base 2. The guide rod 4 extends through, and typically is structured to move through, the fixed jaw 3. The threaded rod 5 extends generally parallel to the guide rod 4. The threaded rod 5 engages a threaded opening (not shown) in the fixed jaw 3. The movable jaw 6 is coupled to the guide rod 4. A first end 5A of the threaded rod 5 extends through, but does not engage, the movable jaw 6. In this configuration, the movable jaw 6 is structured to move toward, or away from, the fixed jaw 3 as the threaded rod 5 is rotated.

The threaded rod 5 is rotated by the locking, removable handle assembly 10. The handle assembly 10 includes a base assembly 12, an elongated handle member 14 and a lock assembly 40. The base assembly 12 is structured to be fixed to the end of the threaded rod 5 that extends through the movable jaw 6. As such, when the handle assembly 10 is rotated, the threaded rod 5 is rotated. The handle member 14 is structured to slide within the base assembly 12 so that a greater length of the handle member 14 may be disposed, alternately, on either side of the threaded rod 5.

The base assembly 12 may be a yoke or similar device but is preferably an elongated tubular member 16. The tubular member 16 has open ends, an inner cross-sectional area and a lateral coupling device 18. The lateral coupling device 18 is disposed on the outer side of the tubular member 16 and is structured to rigidly fix the tubular member 16 to the threaded rod 5. In this configuration, the axis of the tubular member 16 extends generally perpendicular to the axis of the threaded rod 5. In a less preferred embodiment, the base assembly 12 is an opening 16A extending radially through the threaded rod 5.

Figure 2:
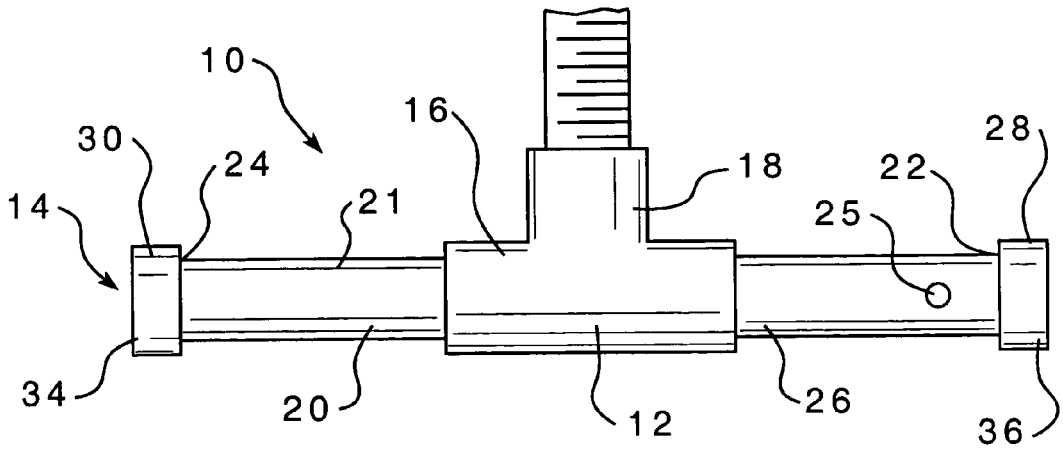
FIG. 2 is a top view of the locking, removable handle assembly for a vise.

In one embodiment, the handle member 14 includes an elongated rod assembly 20 and the lock assembly 40. The rod assembly 20 has a rod 21 with a first end 22, a second end 24, and a medial portion 26 disposed therebetween. The medial portion 26 has a cross-sectional area that is smaller, but preferably just slightly smaller, than the tubular member 16 inner cross-sectional area. Thus, the medial portion 26 of the rod assembly 20 may move axially within the tubular member 16. At the rod first end 22 and second end 24, the rod assembly 20 has, respectively, a first and second wide area portion 28, 30. The wide area portions 28, 30 have a cross-sectional area that is greater than the tubular member 16 cross-sectional area. The wide area portions 28, 30 may be formed by various means or structures. For example, the end of the rod 21 may be bent about ninety degrees, be flared, or be T-shaped. However, as shown in FIGS. 1 and 2, the rod assembly 20 preferably includes a first and second end cap 32, 34. The second end cap 34 is fixed to the rod second end 24. The rod first end 22 includes a cavity 23 sized to accept the lock assembly housing 46 (described below). The rod first end 22 further includes a lock bolt opening 25, or blind hole, extending radially through the rod 21 from the cavity 23. The first end cap 32 is structured to be removably coupled to the rod first end 22 by the lock assembly 40. Accordingly, when the first end cap 32 is coupled to the rod 21, the rod assembly 20 may move axially through the tubular member 16, but not be removed as the end caps 32, 34 are too large to pass through the tubular member 16.

The lock assembly 40 is structured to selectively couple handle member 14 to the base assembly 12. That is, the lock assembly 40 includes a key 42, a lock mechanism 44 having a housing 46 and a bolt 48. The lock mechanism 44 is structured to move the bolt 48 between a first, retracted position, wherein the bolt 48 is disposed within the housing 46, and a second, extended position, wherein the bolt 48 extends from the housing 46. The lock mechanism 44 is actuated by the key 42. In a preferred embodiment, the lock assembly 40 is incorporated into the first end cap 32 with the housing 46 extending from one side of the first end cap 32 and the key hole located on the other side of the first end cap 32.

The first end cap 32 is coupled to the rod 21 as follows. With the bolt 48 in the first, retracted position, the housing 46 is inserted into the cavity 23. The cavity 23 and the housing 46 may have a non-symmetric shape, such as an oval, or have a tongue-and-groove structure to assist in aligning the bolt 48 with the bolt opening 25. The first end cap 32 is positioned with the bolt 48 and aligned with the bolt opening 25. The key 42 is used to actuate the lock mechanism 44 and extend the bolt 48 into the second, extended position. The bolt 48 is then disposed in the bolt opening 25 and prevents the removal of the first end cap 32. Thus, a user who wishes to install a handle assembly 10 on a vise 1 simply installs the rod 21, with the first end cap 32 removed, through the tubular member 16, then installs the first end cap 32 as described above. To remove the handle assembly 10, the user simply reverses the procedure.

Figure 1A:
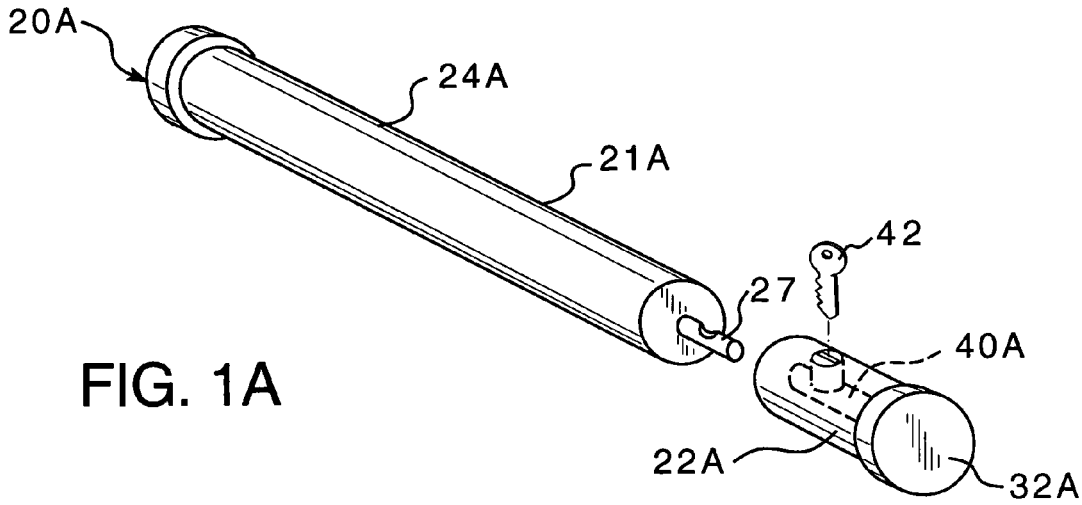
FIG. 1A is an isometric view of the locking, removable handle assembly for a vise with the locking device in a different location.

As shown in FIG. 1A, an alternate rod assembly 20A includes a bifurcated rod 21A wherein the medial portion is split into a first portion 22A and a second portion 24A. In this embodiment, the first end cap 32A and the lock assembly 40A are integral with the first portion 22A. The lock assembly 40A is disposed on the medial portion first portion 22A and is structured to lock onto a stem 27 when actuated by a key. The second portion 24A includes the axial stem 27 structured to be engaged by the lock assembly 40A. In use, this embodiment is functionally similar to the embodiment described above.

Figure 3:
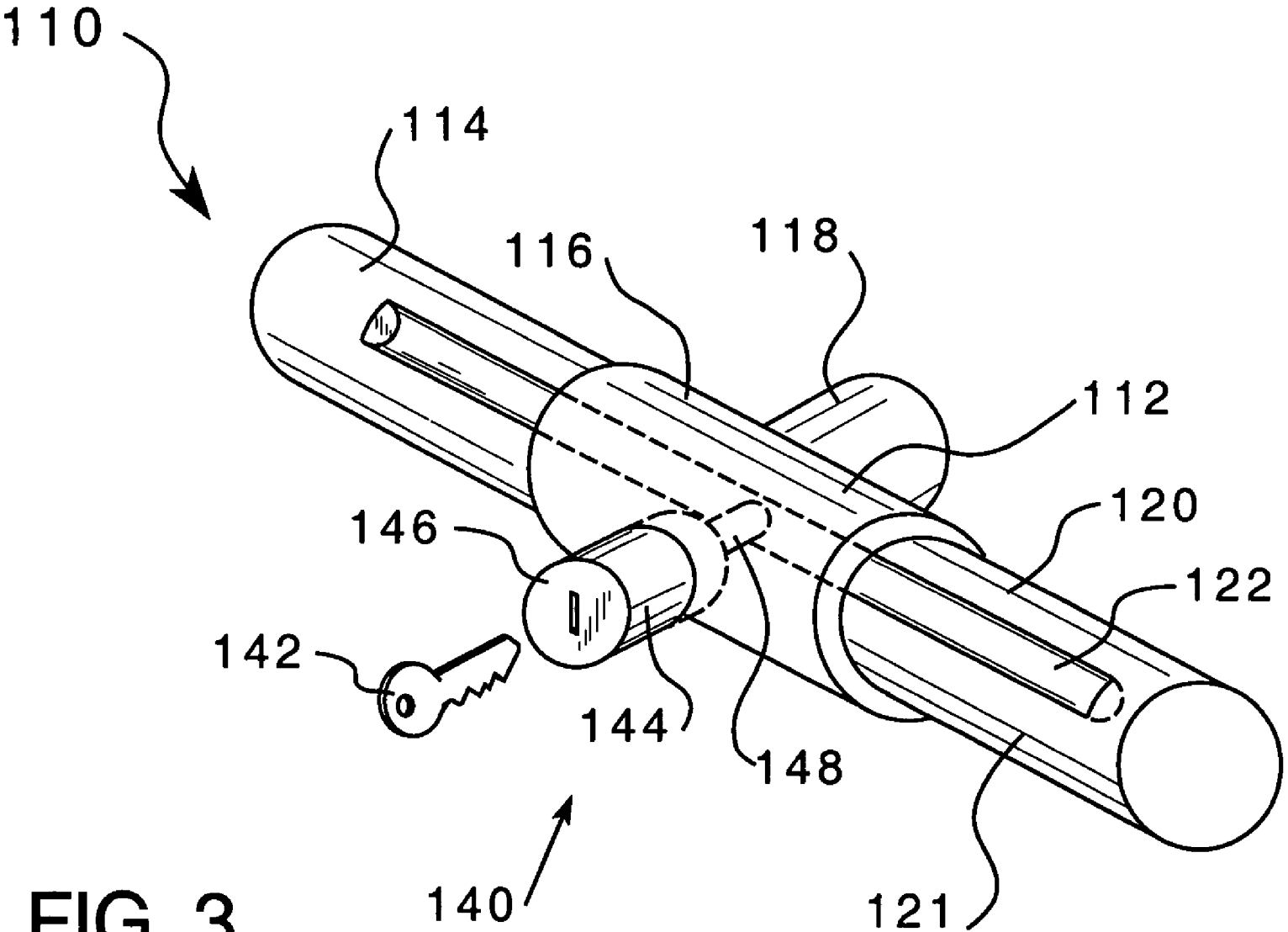
FIG. 3 is an isometric view of an alternate embodiment locking, removable handle assembly for a vise.

Another embodiment of the handle assembly 110 is shown in FIG. 3. In this embodiment, the base assembly 112 is again an elongated tubular member 116. The tubular member 116 has open ends, an inner cross-sectional area, a lateral coupling device 118, and the lock assembly 140. The lateral coupling device 118 is disposed on the outer side of the tubular member 116 and is structured to rigidly fix the tubular member 116 to the threaded rod 5. In this configuration, the axis of the tubular member 116 extends generally perpendicular to the axis of the threaded rod 5. The lock assembly 140 includes a key 142, a lock mechanism 144 having a housing 146 and a bolt 148. The lock mechanism 144 is actuated by the key 142 and is structured to move the bolt 148 between an extended position and a retracted position. Preferably, the lock assembly 140 is also disposed on a lateral side of the tubular member 116, generally opposite the lateral coupling device 118. Further, the bolt 148 preferably moves radially relative to the tubular member 116.

In the embodiment shown in FIG. 3, the handle member 114 is still an elongated rod assembly 120, however, the rod 121 does not have wide end portions, and instead includes a centered channel 122. A "centered channel" is a channel that extends longitudinally along the rod 121, but does not extend to the ends of the rod 121. The rod 121 has a cross-sectional area that is smaller, but preferably just slightly smaller, than the tubular member 116 inner cross-sectional area. The rod 121 and the tubular member 116 may have a non-symmetric shape, such as an oval, or have a tongue-and-groove structure to assist in aligning the bolt 148 with the centered channel 122.

In this embodiment, the handle member 114 is inserted in the base assembly 112 as follows. The key 142 is used to move the bolt 148 into the retracted position. The rod 121 is then inserted in the tubular member 116 with the centered channel 122 aligned with the bolt 148. Once the rod 121 is inserted a sufficient length for the bolt 148 to engage the centered channel 122, the key 142 is used to move the bolt 148 into the extended position. Thus, the bolt 148 is trapped in the centered channel 122 and the rod 121 may only move axially in the tubular member until the bolt 148 contacts one end of the centered channel 122. To remove the handle member 114 from the base assembly 112 the user reverses the procedure. That is, the user utilizes the key 142 to move the bolt 148 into the retracted position wherein the rod 121 may be removed from the tubular member 116.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A locking, removable handle assembly for a vise, said vise having a threaded rod with a first end, said handle assembly comprising:

base assembly structured to be fixed to said threaded rod;

an elongated handle member, structured to be coupled to said base member;

a lock assembly structured to selectively couple said handle member to said base assembly;

said base assembly includes a tubular member having a lateral coupling device, said lateral coupling device structured to engage said threaded rod first end;

said handle member includes a rod having a cross-sectional area sized to fit within said tubular member;

said tubular member has an inner cross-sectional area;

said elongated rod has a medial portion with a first cross-sectional area, a first end and a second end, said first cross-sectional area being smaller than said tubular member inner cross-sectional area;

said handle member further includes a first and second wide area portion, said first and second wide area portions having a second cross-sectional area, said second cross-sectional area being larger than said tubular member;

wherein one wide area portion is disposed at each said end of said rod;

said second wide area portion is fixed to said rod; and said first wide area portion is structured to be removable from said rod;

wherein, when said first wide area portion is removed, said rod may be removed from said tubular member; and wherein said lock assembly is incorporated into said first wide area portion.

2. The locking, removable handle assembly for a vise of claim 1, wherein said lock assembly includes a bolt structured to move between a first retracted position to a second extended position, said bolt disposed at said first end and structured to move radially relative to the longitudinal axis of said rod.

3. A locking, removable handle assembly for a vise, said vise having a threaded rod with a first end said handle assembly comprising:

base assembly structured to be fixed to said threaded rod;

an elongated handle member, structured to be coupled to said base member;

a lock assembly structured to selectively couple said handle member to said base assembly;

said base assembly includes a tubular member having a lateral coupling device, said lateral coupling device structured to engage said threaded rod first end;

said handle member includes a rod having a cross-sectional area sized to fit within said tubular member;

said tubular member has an inner cross-sectional area;

said elongated rod has a medial portion with a first cross-sectional area, a first end and a second end, said first cross-sectional area being smaller than said tubular member inner cross-sectional area;

said handle member further includes a first and second wide area portion, said first and second wide area portions having a second cross-sectional area, said second cross-sectional area being larger than said tubular member;

wherein one wide area portion is disposed at each said end of said rod;

said second wide area portion is fixed to said rod;

said first wide area portion is structured to be removable from said rod;

wherein, when said first wide area portion is removed, said rod may be removed from said tubular member;

said first and second wide area portions include, respectively, a first and second end cap;

said second end cap fixed to said rod second end;

said first end cap removably coupled to said rod first end; and wherein said lock assembly is disposed in said first end cap and is structured to selectively couple said first end cap to said rod first end.

4. The locking, removable handle assembly for a vise of claim 3, wherein said lock assembly is actuated by a key.

* * * * *